US005196861A

United States Patent [19]

Fisher, Sr.

[11] Patent Number: 5,196,861

[45] Date of Patent: Mar. 23, 1993

[54] APPARATUS AND METHOD FOR PROTECTING A FUSER ROLLER

[75] Inventor: Terrence L. Fisher, Sr., Rochester, N.Y.

[73] Assignee: Eastman Kodak Company, Rochester, N.Y.

[21] Appl. No.: 846,107

[22] Filed: Mar. 5, 1992

[51] Int. Cl.[5] ..... B41J 2/325

[52] U.S. Cl. ..... 346/76 PH; 400/120

[58] Field of Search ..... 346/76 PH; 400/120; 219/216

[56] References Cited

U.S. PATENT DOCUMENTS 4,738,555 4/1988 Nagashima ..... 346/76 PH
4,815,872 3/1989 Nagashima ..... 346/76 PH
4,966,464 10/1990 Matoushek ..... 346/76 PH

*Primary Examiner*—Benjamin R. Fuller
*Assistant Examiner*—Huan Tran
*Attorney, Agent, or Firm*—Raymond L. Owens

[57] ABSTRACT

A thermal printer has a fuser roller and a heating element movable relative to the roller between a nonfusing position and a fusing position. At the nonfusing position, the heating element is spaced a first preselected distance from the roller, and at the fusing position, the heating element is spaced a second preselected distance from the roller with the first distance being greater than the second distance. A protective web traverses a path between the heating element and the roller and covers a portion of the roller surface greater than the width of the heating element to thereby protect the roller surface.

4 Claims, 3 Drawing Sheets

APPARATUS AND METHOD FOR PROTECTING A FUSER ROLLER

CROSS-REFERENCE TO RELATED PATENT APPLICATION

This patent application is related to U.S. Pat. application Ser. No. 846,098 filed Mar. 5, 1992 by J. P. Palmer and T. L. Fisher, Sr., which is - filed simultaneously herewith and has a common assignee and one common inventor with this patent application, and which is entitled "PLATEN PROTECTING BORDERLESS THERMAL PRINTING SYSTEM".

TECHNICAL FIELD

This invention relates generally to a thermal printing apparatus, and, more particularly, to a method and apparatus for maintaining a fuser roller in a clean condition while fixing an image on a recording medium by heating.

BACKGROUND OF THE INVENTION

In the process of thermal printing, it is desirable to fuse the printed image to enhance optical properties and to make the image more permanent. There are several methods of fusing. One method of fusing utilizes a dye donor web to impart the color image to a receiver media, and has a clear fuser patch incorporated in the web. After the yellow, magenta and cyan colors are thermally transferred to the receiver media, the clear fuser patch fuses the color image. One of the drawbacks of using a dye donor with a clear fuser patch incorporated therein is the increased probability of artifacts occurring in the finished thermal print.

Another method of fusing utilizes a separate fuser mechanism. The receiver media with the color image thereon is passed between heated rollers in the fuser mechanism. In a mechanism of this sort, a fuser web separate from the dye donor web is provided for the fusing so that it overlays the printed image. Such a system is satisfactory for prints with borders, but creates a problem when the print is borderless. With a borderless print to ensure complete coverage of the image area. Because the fuser web is wider, portions of the fuser web overhang the receiver media, and, when the heating is done, the fuser web contacts the fuser roller. In this process, debris or residue is left on the fuser roller which not only clogs the fuser mechanisms but creates artifacts or other imperfections in the borderless print as well.

Obviously, if the fuser web were properly sized to be exactly as wide as the borderless print, there would be no problem with build-up on the fuser roller or the heating element. As a practical matter, however, it is cost prohibitive to have the fuser web exactly the same size as the borderless print for at least two reasons. First, even when they are designed to be the same size, they are only the same size within certain tolerances, the closer the tolerances the more expensive. Second, because printers typically utilize different sizes of receiver web, it is more efficient to have a one-size-fits-all fuser web to minimize supplies needed to be stocked and to eliminate time required to change fuser webs for different sizes. Accordingly, it will be appreciated that it would be highly desirable to have a fuser mechanism wherein the fuser web is a single width for all widths of receiver media, but does not contribute to residue deposit on the roller or the heating element.

SUMMARY OF THE INVENTION

The present invention is directed to overcoming one or more of the problems set forth above. Briefly stated, according to one aspect of the invention, a thermal printing apparatus comprises a fuser roller having a surface, a heating element having a preselected width and being movable relative the surface between a nonfusing position and a fusing position. At the nonfusing position, the heating element is spaced a first preselected distance from the surface, and at the fusing position, the heating element is spaced a second preselected distance from the surface with the first distance being greater than the second distance. A protective web traverses a path between the heating element and the surface and covers a portion of the surface greater than the width of the heating element to thereby protect the surface.

According to another aspect of the invention, a method for protecting a thermal printing apparatus fuser roller having a surface comprises positioning a heating element having a preselected width and being movable relative to the surface between a nonfusing position at which the heating element is spaced a first preselected distance from the surface and a fusing position at which the heating element is spaced a second preselected distance from the surface with the first distance being greater than the second distance, and inserting a protective web between the heating element and surface and covering a portion of the surface greater than the width of the heating element to thereby protect the surface.

The protective web may be a simple web fed from a supply roll over the fuser roller and taken up by a take-up reel. Or, the protective web may be in the form of an endless belt. By having the protective web wider than the width of the heating element and wider than the width of the borderless print, the protective web covers an area of the fuser roller greater than the width of the borderless print to thereby protect the fuser roller from debris from the fuser web during the fusing process.

These and other aspects objects features and advantages of the present invention will be more clearly understood and appreciated from a review of the following detailed description of the preferred embodiments and appended claim, and by reference to the accompanying drawings.

DETAILED DESCRIPTION OF THE PREFERRED EMBODIMENTS

Figure 1:
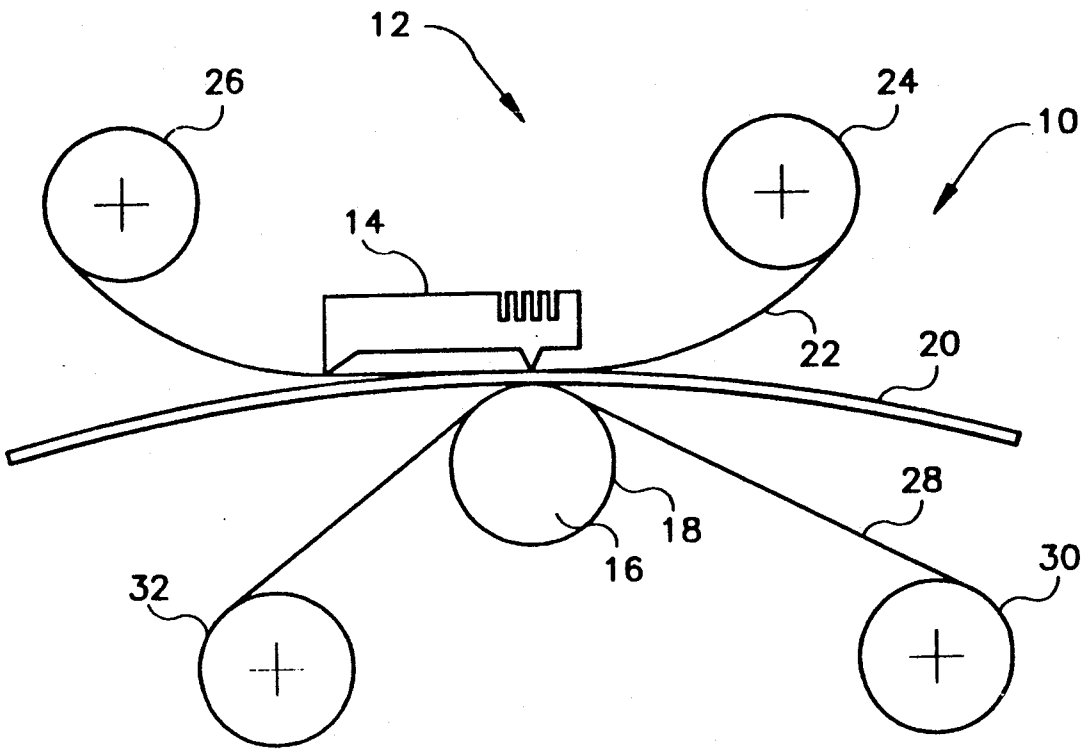
FIG. 1 is a diagrammatic side view of a preferred embodiment of a fuser portion of a thermal printing apparatus incorporating a protective web in accordance with the present invention.

Referring now to the drawings, FIG. 1 illustrates a thermal printing apparatus 10 with a fuser portion 12 that includes a resistive heating element 14 and a fuser roller 16. The fuser roller 16 has a cylindrical surface 18. The heating element 14 has a preselected width and is movable relative to the fuser roller 16 between a nonfusing position and a fusing position. At the nonfusing position, the heating element 14 is spaced a first preselected distance from the surface 18 of the fuser roller 16, and at the fusing position, the heating element 14 is spaced a second preselected distance from the surface 18. The first preselected distance is greater than the second preselected distance so that the movement of the heating element 14 relative to the fuser roller 16 is towards and away from the fuser roller 16.

An image bearing receiver 20 between the heating element 14 and the fuser roller 16 after passing through the dye transfer portion of the thermal printing apparatus 10. An overcoat of fusing web 22 also passes between the heating element 14 and fuser roller 16, and is positioned between the heating element 14 and the image bearing surface of the receiver 20. The fusing web 22 is wound about a supply spool 24, and, after passing between the heating element 14 and fuser roller 16, is taken up by a take-up reel 26.

The protective web 28 is preferably wound about a supply spool 30 and traverses a pathway between the fuser roller 16 and heating element 14 to be taken up by take-up spool 32. The protective web 28 contacts the surface 18 of the fuser roller 16 and thereby lies between the surface 18 of the fuser roller 16 and the nonimage bearing side of the receiver 20.

Figure 2:
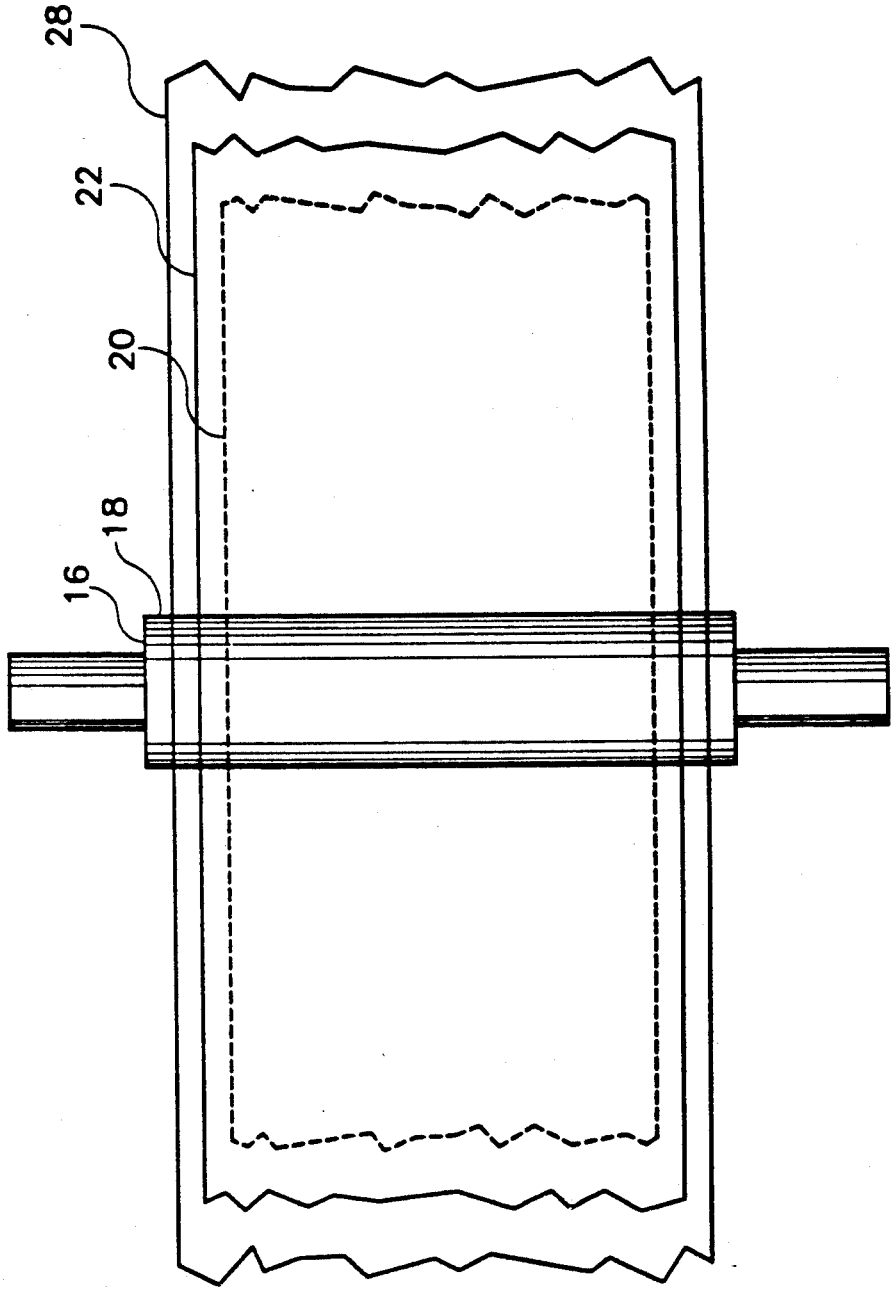
FIG. 2 is a simplified diagrammatic top view illustrating the relationship of the receiver, fusing web and protective web.

Referring now to FIG. 2, the receiver 20 passes over the fuser roller 16 and is not as wide as the roller 16. The overcoat or fusing web 22 passes over the image bearing receiver 20 and is wider than the receiver 20 to ensure full coverage of the width of the receiver 20, even when the receiver 20 is borderless. The protective web 28 contacts the surface 18 of the roller 16 and is wider than the receiver 20 and also wider than the fusing web 22 so that residue from the fusing process is deposited onto the protective web 28 instead of the surface 18 of the fuser roller 16.

Figure 3:
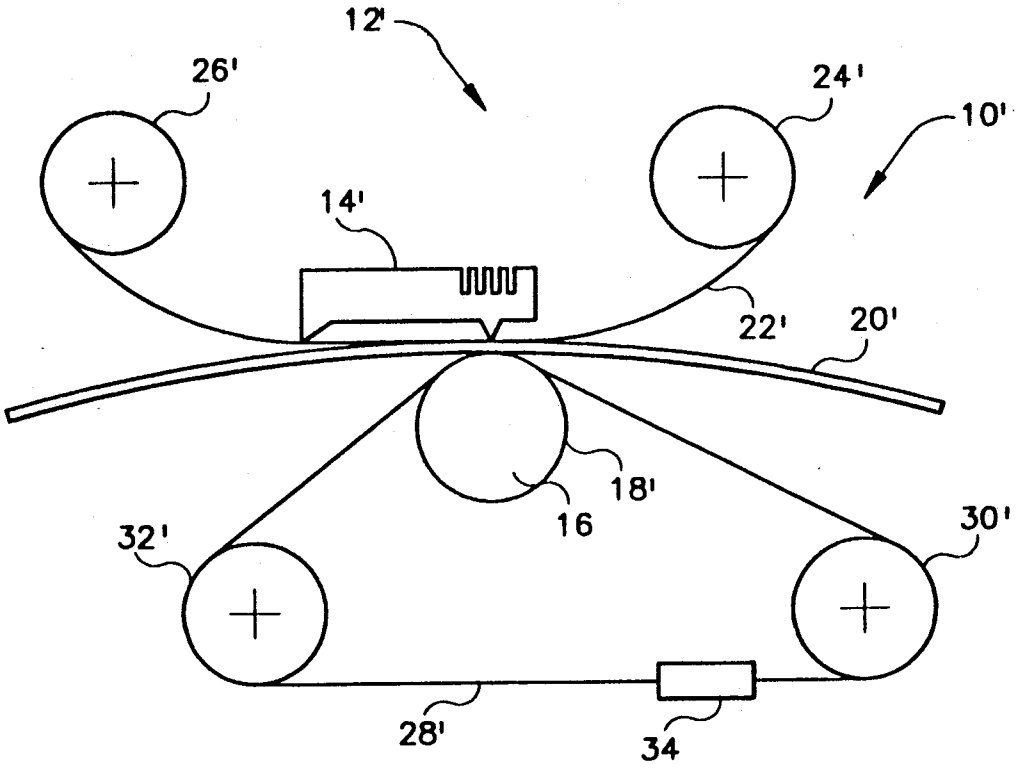
FIG. 3 is a diagrammatic side view similar to FIG. 1 but illustrating another preferred embodiment.

Referring now to FIG. 3, the protective web 28' is shown as an endless web. The web 28' preferably passes over roller members 30' and 32' on the journey over the surface 18' of fuser roller 16'. Preferably, a cleaning apparatus 34 is positioned along the path of the protective web 28' to clean the protective web 28, so that it may be used several times.

Operation of the present invention is believed to be apparent from the foregoing description and drawings, but a few words will be added for emphasis. During operation, the image bearing receiver 20 advances through the area between the fuser roller 16 and heating element 14. The heating element 14 moves from the nonfusing position to the fusing position thereby causing the fusing web 22 to contact the image bearing surface of the receiver 20 and compress the fusing web 22 and receiver 20 against the protective web 28 and the surface of the roller 16. As fusing occurs, the fusing web 22, receiver 20 and protective web 28 advance through the fusing zone. When fusing is complete, the heating element 14 moves from the fusing position to the nonfusing position allowing the overcoat web 22 to be removed from contact with the image bearing surface of the receiver 20. Also in the nonfusing position, the receiver is free to move so that the completed image may be removed and an unfused image may be inserted.

It can now be appreciated that there has been represented a method for protecting a thermal printing apparatus fuser roller that has a cylindrical surface. The method includes positioning the heating element and inserting the protective web between the heating element and the surface of the fuser roller and covering a portion of the surface of the fuser roller to thereby protect the surface from debris from the fuser web.

The invention especially provides a fuser roller protecting system for thermally applying a protective fuser coating (overcoat) on the printed images of an image bearing receiver (sheet, medium) such as recording paper, obtained by previous borderless thermal printing of the receiver. The fuser roller is protected from deposition of the fuser coating material thereon laterally outwardly of the sides of the borderless printed receiver. This is due to the presence of the intervening protective web between the fuser roller and the coating material-containing fusing web, laterally outwardly of the side edges of the receiver, i.e., within the width range of the fusing web.

The previous borderless thermal printing of the receiver may be effected as disclosed and claimed in said copending U.S. application, filed simultaneously herewith.

The fuser coating material contained on the fusing web is generally colorless, heat transferable, normally solid, material of conventional type, typically used to provide a clear overcoat on the printed images of the receiver that adds longevity to the life of the print, e.g., protecting it against deterioration due to ultraviolet light radiation, etc. For instance, the fusing web may be a polyester substrate and the coating material may be a polyurethane based material forming a thermally releasable coating with properties enabling it to bond to the receiver as an overcoat receiving substrate.

By its nature, the fuser coating material is prone to the forming of solid deposits on the fuser roller that not only contaminate the fuser roller surface, but also can build up to such a height as to cause disturbance in the integrity and uniform operation of the heating element and/or in the uniformity of the resulting overcoat on a later used wider image bearing receiver overlying such deposits, in analogous manner to that described in said copending U.S. application.

These problems are avoided by the presence of the protective web which may be of any suitable sheeting material such as paper or fabric (cloth)- that is capable under the fusing conditions of receiving deposits of the fuser coating material, and locally retaining them against migration outwardly of its side edges or through its cross section from its receiving surface facing the fusing web to its underside surface supported on the fuser roller.

Generally, whether the heating element width exceeds, equals or is exceeded by the fuser roller width, the fuser roller is arranged to form a fusing nip with the heating element defining a nip width along their common extent. The width of the protective web and the nip width can exceed the width of the fusing web, or the protective web width can exceed the fusing web width when the fusing web width equals the nip width, or the protective web width and fusing web width can exceed the nip width. For borderless coating of borderless printing on the receiver, the receiver understandably will have the narrowest width of all of the mentioned parts of the assembly. In one case, the protective web width will exceed the nip width when the fusing web width is at least as large as the nip width. In the other case, the protective web width will exceed the fusing web width when the fusing web width is smaller than the nip width.

In all cases, borderless coating of the image receiver by the coating material of the fusing web is guaranteed by lateral coating on the protective web while simultaneously preventing coating of such material on the underlying portions of the fuser roller within the range of the nip width. As the nip width determines the range of coating along the width of the receiver and the adjacent portions of the protective web laterally outwardly thereof, and the protective web width either exceeds the nip width or exceeds the fusing web width, no lateral deposition of coating material on the fuser roller can occur.

While the receiver, fusing web and protective web are typically each provided as a continuous longitudinal element (strip, ribbon), they may be in any suitable form for effecting the coating operation while protecting the fuser roller from deposition of the coating material thereon.

A borderless thermal coating assembly is thus provided for applying a protective coating across the width of an image receiver from one side edge to the other side edge thereof.

The assembly comprises a heating element, and a fuser roller arranged to form a fusing nip with the heating element defining a nip width along their common extent, an image receiver having a width smaller than the nip width and arranged to travel through the nip within the lateral confines of the nip width, and a fusing web of heat transferable coating material. The fusing web has a width larger than the receiver width and sufficient to occupy at least a portion of the nip width, and is arranged to travel through the nip between the heating element and the receiver with the sides of the fusing web extending laterally beyond the sides of the receiver in facing relation to the fuser roller and with the fusing web occupying at least a portion of the nip width.

Significantly, the assembly further comprises a protective web having a width larger than the receiver width and sufficient to exceed the extent of the nip width occupied by the fusing web, and disposed at the nip between the receiver and the fuser roller with the sides of the protective web extending laterally beyond the sides of the receiver and correspondingly beyond the extent of the nip width occupied by the fusing web.

Accordingly, the heating element and fusing web can effect borderless thermal coating of the coating material on the receiver and lateral deposition of the coating material on the protective web adjacent the sides of the receiver while preventing lateral deposition of the co material on the fuser roller.

The cognate method of borderless thermal coating is also contemplated, which comprises providing the above stated assembly and effecting via the heating element and fusing web borderless thermal coating of the coating material on the receiver and lateral deposition of the coating material on the protective web adjacent the sides of the receiver while preventing lateral deposition of the coating material on the fuser roller.

It can also be appreciated that there has been presented a thermal printing apparatus that has a fuser roller with a cylindrical surface, a heating element and a protective web that traverses a path between the heating element and the surface of the fuser roller. The protective web covers a portion of the surface of the fuser roller that is greater than the width of the heating element to thereby protect the surface of the fuser roller from debris from the fuser web.

While the invention has been described with particular reference to the preferred embodiments, it will be understood by those skilled in the art that various changes may be made and equivalents may be substituted for elements of the preferred embodiment without departing from the invention. In addition, any modifications may be made to adapt a particular situation and material to a teaching of the invention particular details of the examples illustrated, and it is therefore contemplated that other modifications and applications will occur to those skilled in the art. For example, while the protective web has been illustrated as traveling in only one direction, it can travel in the reverse direction as well to expose a clean portion for capturing debris. It is accordingly intended that the claims shall cover all such modifications and applications as do not depart from the true spirit scope of the invention.

I claim:

1. A thermal printing apparatus, comprising:

a fuser roller having a cylindrical surface;

a heating element having a preselected width and being movable relative to said surface between a nonfusing position at which said heating element is spaced a first preselected distance from said surface, and a fusing position at which said heating element is spaced a second preselected distance from said surface, said first preselected distance being greater than said second preselected distance; and a protective web traversing a path between said heating element and said surface and covering a portion of said surface greater than said width of said heating element to thereby protect said surface.

2. A method for protecting a thermal printing apparatus fuser roller having a cylindrical surface, comprising the steps of:

positioning a heating element having a preselected width and being movable relative to said surface between a nonfusing position at which said heating element is spaced a first preselected distance from said surface, and a fusing position at which said heating element is spaced a second preselected distance from said surface, said first preselected distance being greater than said second preselected distance; and inserting a protective web between said heating element and said surface and covering a portion of said surface greater than said width of said heating element to thereby protect said surface.

3. A borderless thermal coating assembly for applying a coating across a width of an image receiver having two side edges from one side edges to the other of said side edges thereof, the assembly comprising:

a heating element, and a fuser roller arranged to form a fusing nip with the heating element defining a nip width;

an image receiver having a width smaller than the nip width and arranged to travel through the nip, and a fusing web of heat transferable coating material defining two side web sides and which define a width between such web sides larger than the receiver width and sufficient to occupy at least a portion of the nip width, and arranged to travel through the nip between the heating element and the receiver with the sides of the fusing web extending laterally beyond the sides of the receiver in facing relation to the fuser roller and with the fusing web occupying at least a portion of the nip width; and a protective web defining a width larger than the receiver width and sufficient to occupy at least a portion of the nip width, and arranged to travel through the nip between the heating element and the receiver with the sides of the fusing web extending laterally beyond the sides of the receiver in facing relation to the fuser roller and with the fusing web occupying at least a portion of the nip width; and a protective web defining a width larger than the receiver width and the nip width occupied by the fusing web, and disposed at the nip between the receiver and the fuser roller with the sides of the protective web extending laterally beyond the sides of the receiver and correspondingly beyond the nip width occupied by the fusing web;

whereby to effect by way of heat from the heating element, transfer of fusing web borderless coating material on the receiver and lateral deposition of the coating material on the protective web adjacent the sides of the receiver while preventing lateral deposition of the coating material on the fuser roller.

4. A method of borderless thermal coating for applying a coating across a width of an image receiver having two side edges from one of said side edge to the other of said side edge thereof, the method comprising the steps of:

providing (a) a heating element, and a fuser roller arranged to form a fusing nip with the heating element defining a nip width;

(b) an image receiver having a width smaller than the nip width and arranged to travel through the nip and a fusing web of heat transferable coating material defining two web sides and which define a width between such web sides larger than the receiver width and sufficient to occupy at least a portion of the nip width, and arranged to travel through the nip between the heating element and the receiver with the sides of the fusing web extending laterally beyond the sides of the receiver in facing relation to the fuser roller and with the fusing web occupying at least a portion of the nip width; and (c) a protective web defining a width larger than the receiver width and the nip width occupied by the fusing web, and disposed at the nip between the receiver and the fuser roller with the sides of the protective web extending laterally beyond the sides of the receiver and correspondingly beyond the nip width occupied by the fusing web; and effecting by way of heat from the heating element, transfer f fusing web borderless coating material on the receiver and lateral deposition of the coating material on the protective web adjacent the sides of the receiver while preventing lateral deposition of the coating material on the fuser roller.

* * * * *